United States Patent [19]

Moser

[11] 4,420,923

[45] Dec. 20, 1983

[54] METHOD AND APPARATUS FOR COMBINED GUIDANCE, INCORPORATING A REGISTER, OF TWO CONTINUOUSLY ADVANCED FOIL STRIPS

[75] Inventor: Theo Moser, Steinenberg, Fed. Rep. of Germany

[73] Assignee: Robert Bosch GmbH, Stuttgart, Fed. Rep. of Germany

[21] Appl. No.: 313,513

[22] Filed: Oct. 21, 1981

[30] Foreign Application Priority Data

Oct. 21, 1980 [DE] Fed. Rep. of Germany ..... 3039616

[51] Int. Cl.[3] ..... B65B 41/18; B65B 57/04

[52] U.S. Cl. ..... 53/51; 53/559; 53/389

[58] Field of Search ..... 53/51, 453, 559, 560, 53/141, 389, 553

[56] References Cited

U.S. PATENT DOCUMENTS

| | | | |
|---|---|---|---|
| 2,483,155 | 9/1949 | Salfisberg | 53/51 |
| 3,276,183 | 10/1966 | Carlisle, Jr. et al. | 53/51 |
| 3,294,301 | 12/1966 | Richter | 53/51 X |
| 3,680,446 | 8/1972 | James | 53/51 X |

*Primary Examiner*—Horace M. Culver
*Attorney, Agent, or Firm*—Edwin E. Greigg

[57] ABSTRACT

A method and apparatus are proposed for the combined guidance, incorporating a register, of two continuously advanced foil strips, such as when attaching a foil cover strip to a lower foil strip including container-like recesses. The foil cover strip is preferably of aluminum and has printed legends which must be oriented precisely with respect to the container-like recesses of the lower foil strip. A marking is associated with each legend for scanning by a photo cell. The distribution of the legends and thus of the markings is somewhat closer together than the distribution of the container-like recesses. By stretching the foil cover strip, the distribution of the legends and of the markings can be adapted to the distribution of the container-like recesses. To achieve this, the foil cover strip undergoes a brief clamping in place during its continuous forward movement, during the course of which clamping the clamped area of the strip is distended mechanically, pneumatically or hydraulically to accomplish the desired stretching. A stretching apparatus is provided perform this method, substantially comprising an oscillating lifting press system. The oscillating lifting press system cooperates with a counterpart element. The foil cover strip is firmly clamped in a slip-free manner by clamping devices, so that within the clamped area round rods provided in the oscillating lifting press system and the counterpart element can stretch the foil cover strip.

6 Claims, 5 Drawing Figures

FIG. 4
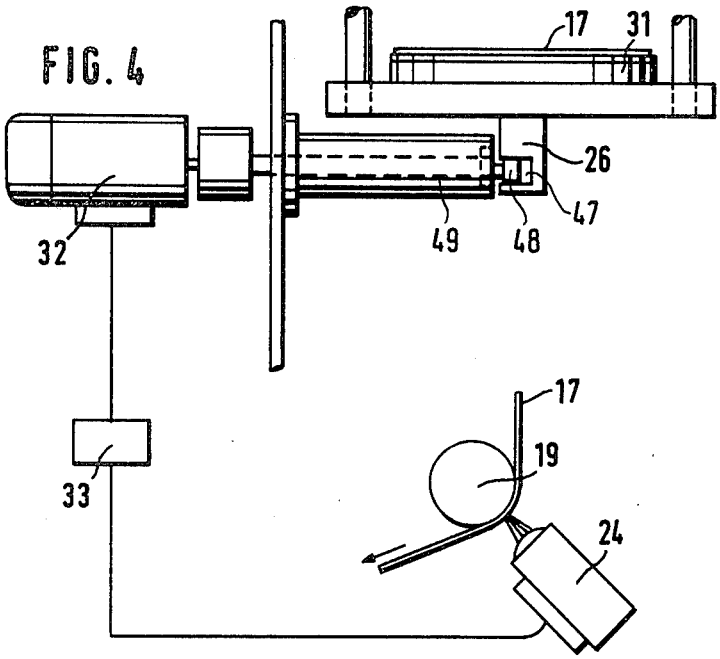
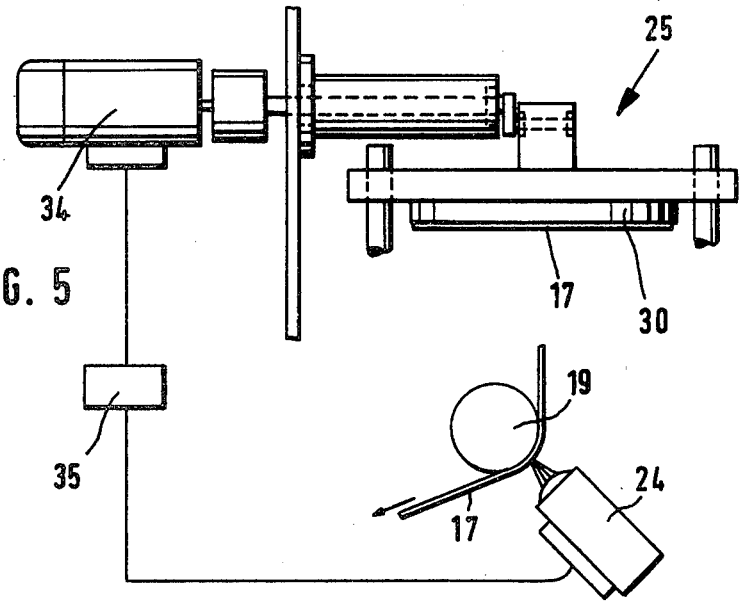
FIG. 5

METHOD AND APPARATUS FOR COMBINED GUIDANCE, INCORPORATING A REGISTER, OF TWO CONTINUOUSLY ADVANCED FOIL STRIPS

BACKGROUND OF THE INVENTION

In the packaging of pharmaceutical products, such as tablets, capsules, dragees or the like, so-called press-to-eject packages are preferably used. These packages are fabricated, filled and sealed on one and the same machine in such a manner that a thermoplastically deformable foil strip, after being heated, is provided at a forming station with deep-drawn depressions, which are then filled with tablets or the like and then sealed by pressing a foil cover strip, preferably of aluminum, over them. Finally, the desired package sizes are stamped out from the strips and then generally delivered to a cartoning machine and packed, either individually or in groups, in folding boxes. In order to identify the contents, the foil cover strip is provided with an appropriate printed legend. It is of utmost importance that the foil cover strip be guided together with the lower foil strip—that is, the one having the container-like recesses filled with tablets or the like—in such a way that each of the package units so formed contains a complete legend. In order to provide continuous monitoring of the preferably continuous advancement of the foil cover strip, markings which can be scanned by photoelectric devices are incorporated in the legend. Means are further provided which exert influence on either the foil cover strip or the lower foil strip having the container-like recesses, depending on the outcome of the scanning of the markings on the foil cover strip. This influence may be exerted such that one of the two continuously advanced foil strips is briefly either accelerated or slowed down. It has also already been proposed that the foil cover strip be shortened in length by forming a loop (German Pat. No. 14 61 923). In that case, the loops are each placed between two package units, so that when the package units are stamped out later from the larger strip, the loops are cut away and discarded. This manner of operation, however, causes a relatively great waste of foil, which makes for uneconomical production of the tablet strip packages; this is particularly true when aluminum is used, as is the case at present.

Another known apparatus (German Auslegeschrift No. 26 53 196) makes use of the fact that the aluminum foil cover strip is stretchable within certain limits. The distance between sequential printed legends on this foil cover strip is shorter than the length of the packages to be closed, so that the deviation in spacing of the legends can be corrected by stretching the foil cover strip. When a cover strip of metal foil is used (foil cover strip) in the known apparatus, this stretching is accomplished by disposing a multiplicity of stationary parallel rods in the stretching zone; these rods have transversely disposed edges engaging opposite sides of the metal strip such that the metal strip is deflected in a zigzag pattern. These rods thereby accomplish a stretching of the foil cover strip, and this stretching effect may be increased or decreased, depending on what is required, by varying the tension of the foil cover strip. The regulation of the tension and thus of the extent to which the foil cover strip is stretched is accomplished by braking a roller; the braking times are controlled in accordance with a photo cell which scans the markings on the foil cover strip.

A great disadvantage of this known apparatus is that as a result of the increase in tension—since stretching can be attained only in this way—scratch and abrasion marks are made on the foil cover strip. Furthermore, the danger that the foil cover strip will tear in the course of such an operation cannot be ruled out entirely. There is also an uncertainty factor relating to stretching the foil cover strip by varying the strip tension in accordance with the braking of the roller. Unequivocally replicable values can be attained only with difficulty in such an apparatus.

It would be desirable at this time to have a method, and a corresponding apparatus for performing the method, in which the stretchability of the aluminum foil cover strip is provided, while the two continuously advanced foil strips are guided in combination, incorporating a register, without damaging the foil cover strip in so doing.

OBJECT AND SUMMARY OF THE INVENTION

It is an object of the invention to provide a method and an apparatus for guidance of two continuously advanced foil strips wherein the stretching of the foil cover strip is effected by mechanical action during the continuous advancement of the strip.

It is a further object of the invention that the tension in the foil cover strip is not affected during stretching, thus eliminating tearing of the strip, and no scratches of any kind are made on the foil cover strip.

It is another object of the invention to provide an apparatus for performing the method distinguished by simplicity of manipulation and efficient mode of operation, thus assuring reliable combined guidance, incorporating a register, of the two foil strips. Tablet strip packages are thereby produced which exhibit no signs of the fact that the foil cover strip was subjected to a stretching procedure.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 4 is a schematic view of the invention showing the adjustment of the counterpart in accordance with a scanning device; and FIG. 5 shows another embodiment of the oscillating lifting press system and of the counterpart element, in which a separate drive means for the oscillating lifting press system is controlled by a scanning device.

DESCRIPTION OF THE PREFERRED EMBODIMENT

Figure 1:
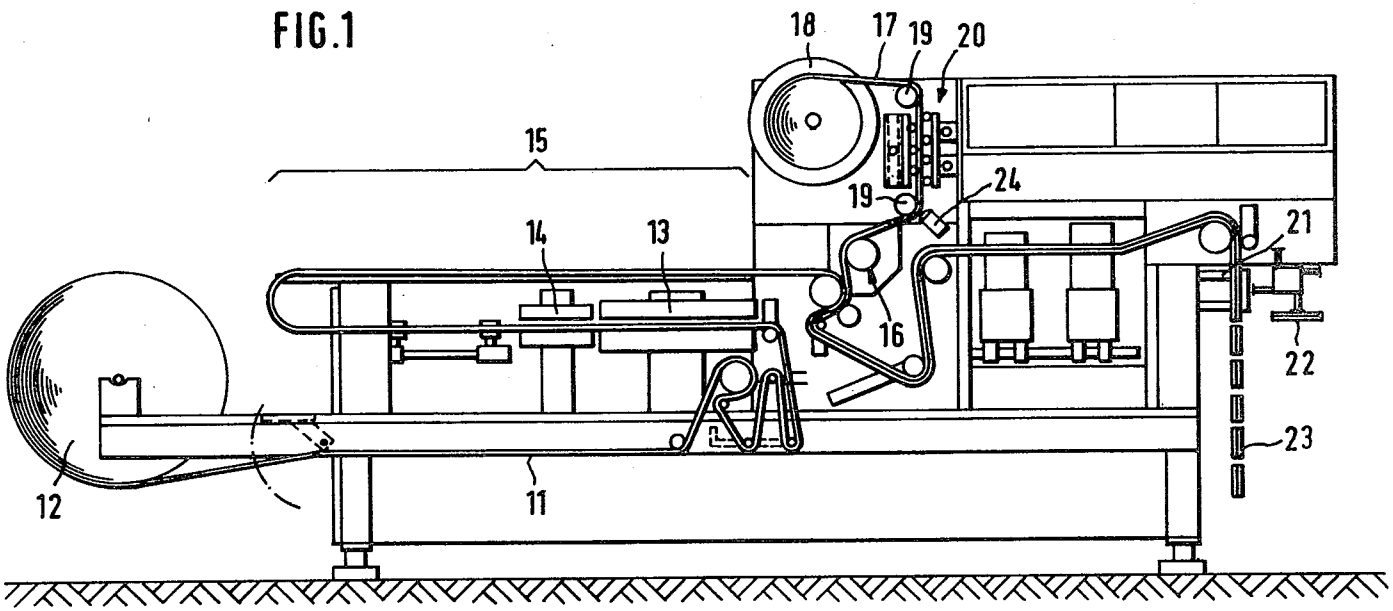
FIG. 1 is a side elevational view of a thermoforming machine, shown schematically.

As may be seen from FIG. 1, a lower foil strip 11 is unwound from a supply roll 12 and delivered via various deflector rollers, after passing through a heating station 13, to a molding station 14. The foil strip 11, now provided with container-like recesses (not shown), is then diverted and passes through a filling zone indicated at 15. The container-like recesses are filled by known supply and insertion apparatuses, not shown, for tablets, capsules, dragees or the like. The filling zone 15 is followed by a sealing station 16, in which a foil cover strip 17 is pressed onto the container-like recesses of the lower foil strip 11 in order to seal them. The foil cover strip 17, preferably of aluminum foil, is unwound from a supply roll 18 and delivered via deflector rollers 19, after passing through a stretching apparatus 20, to the sealing apparatus 16. The foil strips 11 and 17, now sealed to one another, then pass through a perforating and impressing apparatus (not shown). Finally, individual package strips are punched out with the aid of a punching apparatus 21, from which the finished package strips 22 are removed with the aid of rotating suction devices and delivered to a conveyor belt, not shown, belonging for example to a cartoning machine. The lattice-like trimmings 23 resulting from the punching operation may be wound up in a roll or may subsequently be shredded. In order to scan the markings which are present on the foil cover strip, but which are not shown in the FIG. 1 schematic embodiment, a scanning device in the form of a photo cell 24 is disposed between the stretching apparatus 20 and the sealing station 16.

Figure 2:
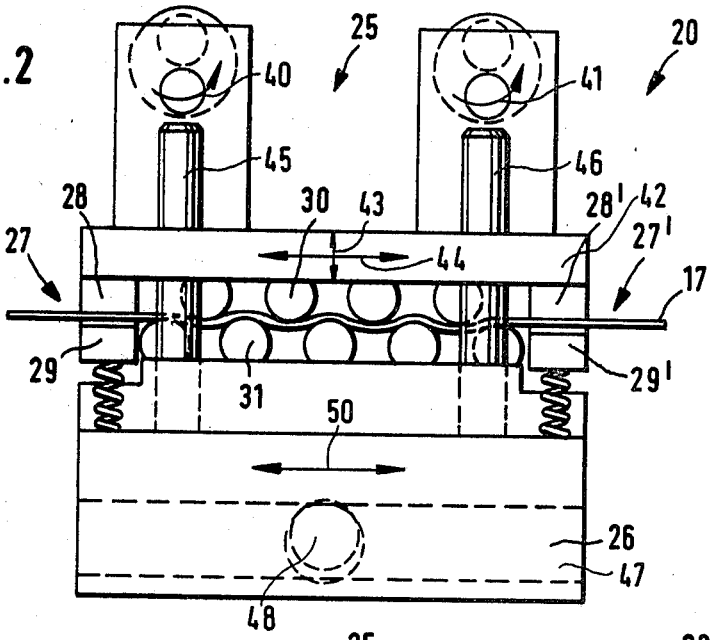
FIG. 2 is a sectional view of the apparatus according to the invention showing an oscillating lifting press system and a counterpart element connected therewith with the system engaging a foil strip.
Figure 3:
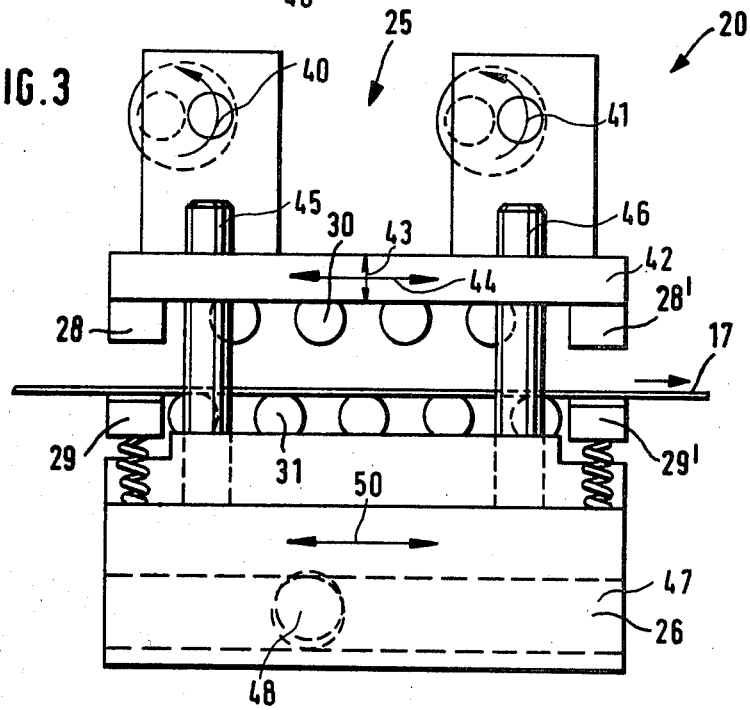
FIG. 3 is a sectional view of the invention analogous to FIG. 2 but with the system disengaged from the foil strip.

In FIGS. 2 and 3, the stretching apparatus 20 is shown on a larger scale. The stretching apparatus 20 substantially comprises an oscillating lifting press system 25, which is associated with a counterpart element 26 which moves in only one plane. The counterpart element 26 is connected with the oscillating lifting press system 25 via ball guides, not shown. In order to fasten a particular length of the foil cover strip 17 in place, clamping devices 27, 27′ are provided, each of which comprises fixed clamping pieces 28, 28′ secured on the oscillating lifting press system 25 and clamping pieces 29, 29′ elastically secured on the counterpart element 26. The elements are arranged such that the distance from center to center of the clamping devices 27, 27′ is approximately equal to the circumference of the path of the oscillating lifting press system. The speed at the circumference of the oscillating lifting press system 25 is adapted to the speed with which the foil cover strip 17 moves forward. In order to exert mechanical influence on the foil cover strip 17, fixedly disposed round rods 30 and 31 are secured in alternation relative to one another on both the oscillating lifting press system 25 and on the counterpart element 26; that is, the fixedly disposed round rods 30 and 31 are disposed in staggered fashion.

The mode of operation of the stretching apparatus 20 is as follows:

Upon each revolution of the oscillating lifting press system 25, whose circumferential speed is adapted to the forward speed of the foil cover strip 17, the foil cover strip 17 is briefly clamped by the clamping devices 27, 27′ such that it cannot slip out of place. As the oscillating lifting press system 25 advances toward the foil cover strip 17, the clamping pieces 28, 28′ and 29, 29′ first meet, clamping the foil cover strip 17 in place. As the oscillating lifting press system 25 continues to move, the clamping pieces 29, 29′ are pressed back, so that a distention mechanism, in the form of the round rods 30, 31, emerges. The foil cover strip 17 is stretched solely by the opposite-directed movement of the round rods 30, 31 relative to one another, as shown in FIG. 2.

The clamping of the foil cover strip 17 is effected by the downward movement of the oscillating lifting press system, which moves in the direction indicated by the arrows 40 and 41 in FIGS. 2 and 3. As a result, the movement of the plate 42 on which the round rods 30 are secured is reciprocal in both the vertical and horizontal directions simultaneously, as indicated by arrows 43, 44 (FIG. 2). FIG. 2 also shows the lowermost final position of the oscillating lifting press system, in which the foil cover strip 17 is clamped between the clamping pieces 28, 29 and 28′, 29′. The round rods 30 thus depress the foil cover strip 17, within the area which is clamped, into the gaps present between two adjacent round rods 31, in turn, depress the foil cover strip 17 into the gaps between adjacent round rods 30. The result is a stretching of the foil cover strip 17 in this clamped area. It is not possible for the foil cover strip 17 to become wrinkled during this procedure, because this area is held in place by the clamping pieces 28, 29 and 28′, 29′.

The counterpart element 26 is guided via bolts 45, 46 in ball guides (not shown) of the plate 42 of the oscillating lifting press system. The counterpart element 26 furthermore has a groove 47, in which a ball bearing 48 of the adjustment device 49 is guided. As a result, when the oscillating movement of the oscillating lifting press system is effected in the direction of the arrows 40, 41, there is a linear reciprocating movement on the part of the counterpart element 26 along the direction indicated by arrow 50.

The bolts 45, 46 are actuated by axial forces applied to the bolts in the direction of the arrows 40, 41. When these forces are applied alternatively, the result is reciprocating movement 50 applied to the counterpart element 26.

The desired extent of stretching may be set by adjusting the counterpart element 26, as shown in FIG. 4. To this end, a servomotor 32 is provided, which can be influenced via a control unit 33 in accordance with the result of scanning with the photo cell 24. As the oscillating lifting press system 25 continues to revolve, the foil cover strip 17 is released once again by the clamping devices 27, 27′. By adapting the circumferential speed of the oscillating lifting press system to the speed of forward movement of the foil cover strip 17, it is assured that the foil cover strip 17 will undergo stretching over its full length.

While with the apparatus described above, a stretching procedure is axiomatically performed, and it is merely the extent of stretching which is varied by means of the photo cell 24 in accordance with the position of the markings on the foil cover strip 17, FIG. 5 shows an apparatus in which the oscillating lifting press system does not revolve continuously, so that a stretching procedure cannot be performed axiomatically. In this apparatus, the elements are arranged such that the oscillating lifting press system 25 is equipped with its own drive means 34. It is thereby possible to cause the oscillating lifting press system 25 to revolve only when the photo cell 24 ascertains a change in position of the markings on the foil cover strip 17. In other words, stretching of the foil cover strip 17 is effected only when the markings on the foil cover strip 17 do not reach the photo cell 24; that is, when the photo cell cannot recognize any marking. If this eventuality occurs, then the drive means 34 of the oscillating lifting press system 25 is switched on, via a control unit 35, until such time as the foil cover strip 17 has stretched to such a length that the photo cell 24 again detects the appropriate markings.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. An apparatus for producing a unitized strip containing preformed package units, each of said units bearing a complete legend thereon, comprising a supply source for a first strip of deformable material, means for advancing a leading edge of said first strip of deformable material to a heating station, means for conveying said first heated strip to a molding means, said molding means arranged to produce recesses in said first heated strip, means for advancing said first strip to a filling station, means associated with said filling station to control filling said recesses; means for advancing said first strip to a sealing station, a supply source for a second strip of deformable material, means for advancing a leading edge of said second strip of deformable material to a stretching station, clamping means in said stretching station adapted to clamp a portion of said second strip of deformable material, distention means arranged to cooperate with said clamping means to selectively stretch said second strip of deformable material, means for advancing said second strip to a scanning station, said stretching station including an oscillating lifting press system ahead of said scanning station and said second strip has a predeterminate feed rate, said system being adapted to said feed rate; said clamping means comprises first and second pairs of aligned clamping devices associated with the oscillating lifting press system and said pairs of aligned clamping devices are separated by a distance from center to center equal to a circumferential path of the oscillating lifting press system; means in said scanning station for sensing markings applied to said second strip of deformable material, means associated with said scanning station for actuating said clamping means and said distention means in response to relative positions of said markings, means for advancing said second strip of deformable material to said sealing station, means in said sealing station for sealing said strips into said unitized strip, means for advancing said unitized strip to a perforating and punching station, means in said perforating and punching station for severing said package units from said unitized strip and thereafter discharging said package units from the apparatus, whereby each package unit bears a complete legend thereon.

2. An apparatus as defined by claim 1, further wherein said oscillating lifting press system and said counterpart element each include round rods comprising said distention means.

3. An apparatus as defined by claim 1, further wherein each of said clamping devices comprises two oppositely disposed clamping pieces, at least one of said clamping pieces being elastically supported in said stretching station.

4. An apparatus as defined by claim 1, wherein said apparatus includes a drive means and said oscillating lifting press system is provided with further drive means independent of said apparatus drive means, said oscillating lifting press drive means being adapted to be switched on and off via a control unit responsive to a photo cell.

5. An apparatus for producing a unitized strip containing preformed package units, each of said units bearing a complete legend thereon, comprising a supply source for a first strip of deformable material, means for advancing a leading edge of said first strip of deformable material to a heating station, means for conveying said first heated strip to a molding means, said molding means arranged to produce recesses in said first heated strip, means for advancing said first strip to a filling station, means associated with said filling station to control filling said recesses; means for advancing said first strip to a sealing station, a supply source for a second strip of deformable material, means for advancing a leading edge of said second strip of deformable material to a stretching station, clamping means in said stretching station adapted to clamp a portion of said second strip of deformable material, distention means arranged to cooperate with said clamping means to selectively stretch said second strip of deformable material, means for advancing said second strip to a scanning station, said stretching station including an oscillating lifting press system ahead of said scanning station and said second strip has a predeterminate feed rate, said system being adapted to said feed rate; said stretching station further including a counterpart element operable in one plane and said counterpart element is arranged to cooperate with said oscillating lifting press system via ball guide means disposed therein; means in said scanning station for sensing markings applied to said second strip of deformable material, means associated with said scanning station for actuating said clamping means and said distention means in response to relative positions of said markings, means for advancing said second strip of deformable material to said sealing station, means in said sealing station for sealing said strips into said unitized strip, means for advancing said unitized strip to a perforating and punching station, means in said perforating and punching station for severing said package units from said unitized strip and thereafter discharging said package units from the apparatus, whereby each package unit bears a complete legend thereon.

6. An apparatus as defined by claim 5, wherein said means associated with said scanning station for actuating said distention means comprises a servomotor associated with said counterpart element and said means for sensing markings comprises a photo cell, said photo cell arranged to actuate said servomotor via a control unit, whereby stretching of said second strip can be varied.

* * * * *